US005272957A

United States Patent [19]

Chesnut et al.

[11] Patent Number: 5,272,957

[45] Date of Patent: Dec. 28, 1993

[54] FIREARM WITH PLASTIC MATERIAL

[75] Inventors: M. Gaines Chesnut, Golden, Colo.; Ernest Brandenburg, Dallas, Tex.

[73] Assignee: Ram-Line, Inc., Golden, Colo.

[21] Appl. No.: 879,957

[22] Filed: May 6, 1992

Related U.S. Application Data

[63] Continuation of Ser. No. 436,369, Nov. 14, 1989, abandoned.

[51] Int. Cl.[5] ..... F41A 11/00

[52] U.S. Cl. ..... 89/195; 42/69.03; 42/75.02; 42/75.03; 89/145

[58] Field of Search ..... 42/6, 7, 69.03, 71.01, 42/71.02, 75.02, 75.03; 89/195

[56] References Cited

U.S. PATENT DOCUMENTS

| | | | |
|---|---|---|---|
| 2,468,784 | 5/1949 | Seagraves | 89/195 |
| 2,655,839 | 10/1953 | Ruger | 42/69.03 |
| 3,087,270 | 4/1963 | Stoner | 42/50 |
| 3,383,790 | 5/1968 | Into | 42/50 |
| 3,399,480 | 9/1968 | Rowe, Jr. | 42/50 |
| 3,453,762 | 7/1969 | Fremont | 42/50 |
| 3,577,860 | 5/1971 | Jestrabek | 42/50 |
| 3,611,873 | 10/1971 | Ellison | 89/195 |
| 3,736,686 | 6/1973 | Moller et al. | 42/6 |
| 4,107,862 | 8/1978 | Sofinowski, III | 42/50 |
| 4,127,954 | 12/1978 | Hausmann | 42/50 |
| 4,139,959 | 2/1979 | Howard et al. | 42/50 |
| 4,539,889 | 9/1985 | Glock | 89/147 |
| 4,580,364 | 4/1986 | Vyprachticky | 42/50 |
| 4,703,826 | 11/1987 | Byron | 89/188 |
| 4,769,938 | 9/1988 | Chesnut et al. | 42/76.02 |
| 4,776,122 | 10/1988 | Dieringer et al. | 42/50 |
| 4,790,094 | 12/1988 | Chesnut et al. | 42/50 |
| 4,967,503 | 11/1990 | Farrar | 42/71.02 |

FOREIGN PATENT DOCUMENTS

| | | | |
|---|---|---|---|
| 149137 | 3/1952 | Australia | 42/50 |
| 3522155 | 1/1986 | Fed. Rep. of Germany | 42/71.02 |

OTHER PUBLICATIONS

RamLine, Inc., "Ram-Line Unique by Design Accessories '89 Made in the U.S.A.", Products Catalog pp. 1-7, published 1988 in the U.S.A.

*Primary Examiner*—Stephen C. Bentley

*Attorney, Agent, or Firm*—Sheridan Ross & McIntosh

[57] ABSTRACT

A firearm (10) is provided which is light weight, safe and simple to operate. The firearm (10) comprises a bolt-barrel-receiver assembly (12), a grip assembly (14) and a magazine assembly (16). the bolt-barrel-receiver assembly (12) comprises a barrel assembly 41, a receiver assembly, (42) and a bolt assembly (44). The grip assembly (14) comprises a grip body (110) and a fire control assembly (112). Plastic is incorporated into the barrel assembly (41), the fire control assembly (112) and the grip body (110). The firearm (10) incorporates several safety features through a safety actuator (222) and a disconnect (148). These safety features include a surface (243) for blocking movement of a sear (120), a blocking surface (248) for blocking movement of the disconnect (148) and a hammer passage (246) allowing blocking of the hammer (118). Due to the design of the various assemblies, the firearm (10) is comparatively simple to disassemble for cleaning or repair. A takedown screw (158) allows separation of the grip assembly (14) from the bolt-barrel-receiver assembly (12). A frame retaining pin (224) allows removal of the fire control assembly (112) from the grip body (110).

1 Claim, 11 Drawing Sheets

FIREARM WITH PLASTIC MATERIAL

This application is a continuation, of application Ser. No. 07/436,369, filed Nov. 14, 1989, now abandoned.

TECHNICAL FIELD OF THE INVENTION

This invention relates to firearms and, in particular, to a firearm with plastic components, multiple safety features and advantageous fire control.

BACKGROUND OF THE INVENTION

As plastic materials become more and more widely used as replacements for metal, their incorporation into firearms is inevitable. Plastics have already been used in the manufacture of magazines for firearms for many years and have resulted in the issuance of patents, for example, U.S. Pat. No. 4,509,283, to Chesnut, Apr. 9, 1985. Additionally, plastics have been suggested and disclosed for use in other components of firearms such as a pistol grip as disclosed in U.S. Pat. No. 4,539,889, to Glock, Sep. 10, 1985. The Glock patent requires the molding of plastic around metallic pieces, thus, while the grip of the Glock pistol may be plastic, it still requires integral metal pieces to function. Additionally, there has even been a patent issued on a metal lined plastic barrel, U.S. Pat. No. 4,769,938 to Chesnut et al. Sep. 13, 1988.

Another well-known use of plastic materials and firearms can be seen in the current U.S. Army standard issue assault rifle, designated the M-16. In the M-16, the stock and forearm are made of a strong, light weight plastic material.

Nonetheless, it sill remains worthwhile to provide a firearm which better utilizes plastic in the composition thereof. An important purpose of the present invention is to use plastic(s) wherever practicable in the firearm. The advantage of such use is clear, i.e., the weight of the forearm is decreased by the increased use of plastics. It is also an important aspect of the present invention that the firearm is provided with enhanced safety features that are both reliable and easy to use by the firearm user or shooter.

Typically a firearm contains one or more safety features to prevent unwanted firing thereof. For example, U.S. Pat. No. 4,422,254, to McQueen, Sep. 27, 1983, discloses the use of a sear block, U.S. Pat. No. 4,208,947, to Hillberg, Jun. 24, 1980, discloses a hammer block and U.S. Pat. No. 4,282,795, to Beretta, Aug. 11, 1981, discloses a firing pin block.

Additionally, the fire control of most firearms involves the interaction between a trigger, a disconnect bar, a sear and a hammer. The forces required to make the appropriate interactions work are provided by various tension and compression springs. Unfortunately, such springs tend to provide a gradually increasing force through their operating range. Thus when such springs are used, for example, as the controlling force to remove a sear from a cocked hammer (i.e. trigger pull), it is necessary to provide an increasing pressure to counteract the spring force up to the touch off point (where the sear releases the hammer). While higher trigger pull makes for a safer firearm, the change in required force is often distracting. After gradually increasing the pressure on the trigger, an operator suddenly has a nearly complete loss of pressure which may result in over compensation and a missed shot.

The sear/hammer interface is another area in many existing firearms which is open to improvement. The interface is typically located proximate the axis of rotation of the hammer where the forces acting on the hammer to bias the hammer in a specific direction, are greatest. Thus, to resist the hammer biasing force, a greater sear counter force is required which obviously requires a greater trigger pull to overcome. Thus, there is a need for a firearm that is lightweight, safe to operate and requires a constant force to fire.

SUMMARY OF THE INVENTION

The present invention disclosed herein describes a firearm with plastic, polymeric or resinous material (hereinafter referred to as plastic) components which greatly reduce the overall weight of the firearm. In one embodiment, the present invention has a significant weight reduction (i.e., roughly ⅓ less) when compared to a RUGER MK-II. The present invention uses plastic materials with the barrel assembly, hand grip and wherever practicable within the inner workings of the firearm. The present invention incorporates a plurality of interrelated safety devices and is also provided with a conforce spring for a steady trigger pull. In the preferred embodiment, the firearm comprises a semi-automatic 0.22 caliber pistol using standard rim fire cartridges.

In accordance with one aspect of the invention, a metal lined plastic barrel group is formed. The barrel group comprises a metal-lined plastic barrel fixed to a metal barrel shank which is in turn fixed to a metal receiver group.

A fire control assembly comprises fire control frames, a sear, and a hammer. In the preferred embodiment of the present invention, the fire control frames are formed from plastic. A negator/constant force (conforce) spring is used to bias the sear to provide a constant force in conjunction therewith, allowing application of an even force on the trigger to fire a cartridge.

The sear comprises a pivoting metallic portion with at least one pin protruding therefrom for engagement with the disconnect bar. As the firearm is cocked, placing the hammer in the ready-to-fire, or cocked position, the sear is pivoted into contact with the hammer by the conforce spring to hold the hammer in the cocked position. The sear, operatively connected to the trigger through the disconnect bar, may be moved by pulling the trigger. The sear moves in a pivoting motion away from the hammer, thus releasing the hammer to fire a cartridge.

A disconnect is formed with a firing contact surface, a sear blocking surface and a safety engaging surface. The sear can be purposely moved by pulling the trigger when the firing contact surface is in contact with the sear. If the firing contact surface of the disconnect is disengaged from the sear, the blocking surface on the disconnect prevents the accidental movement of the sear. When the safety engaging surface of the disconnect is in contact with a safety catch, the disconnect cannot be moved and the trigger cannot be pulled. Thus, the sear is similarly prevented from movement by the blocking surface on the disconnect. Therefore, the disconnect provides a three-way safety by blocking, disengaging and locking.

A safety lever is provided on the exterior of the handgrip. The lever requires a dual motion, axially and radially, to disengage from the "safe" condition. A simple axial push of the lever with the thumb, followed by a rotational movement thereof must be used to purposely disengage the safety lever. This dual movement is fairly natural for the human thumb but is difficult to achieve accidentally such as by dropping the firearm.

The safety lever is operatively connected to the disconnect through the frame of the firearm by a safety lever bar. The bar includes a cutout portion which must be positioned properly (safety lever in the "off" position) to allow passage of the hammer therethrough to fire a cartridge. The safety lever bar is also provided with protrusions on an end opposite the safety lever for contact with the disconnect when in the "safe" position. The protrusion engages the disconnect which prevents movement of the disconnect bar and the trigger.

In a preferred embodiment, a plastic pistol grip receives the fire control assembly and the receiver group. The pistol grip has a central chamber running therethrough for receiving a plastic magazine therein. The plastic magazine is designed to contain a plurality of cartridges for the firearm. A bolt face contacts the uppermost cartridge in the magazine to extract that cartridge and insert it into the chamber. After the gasses from the fired cartridge cause the bolt to slide back over the top of the magazine, extracting the spent casing of the cartridge, the magazine causes the next cartridge to be moved into a loading position for contact with the bolt.

It is a technical advantage of the present invention that plastics are used wherever practicable to lighten the overall weight of the firearm. It is a further technical advantage that the firearm is positively prevented from accidental firing with the safety engaged. It is a still further technical advantage of the present invention that the sear is controlled by a conforce spring.

BRIEF DESCRIPTION OF THE DRAWINGS

For a more complete understanding of the present invention and for further advantages thereof, reference is now made to the following Detailed Description taken in conjunction with the accompanying Drawings, in which.

Figure 3:
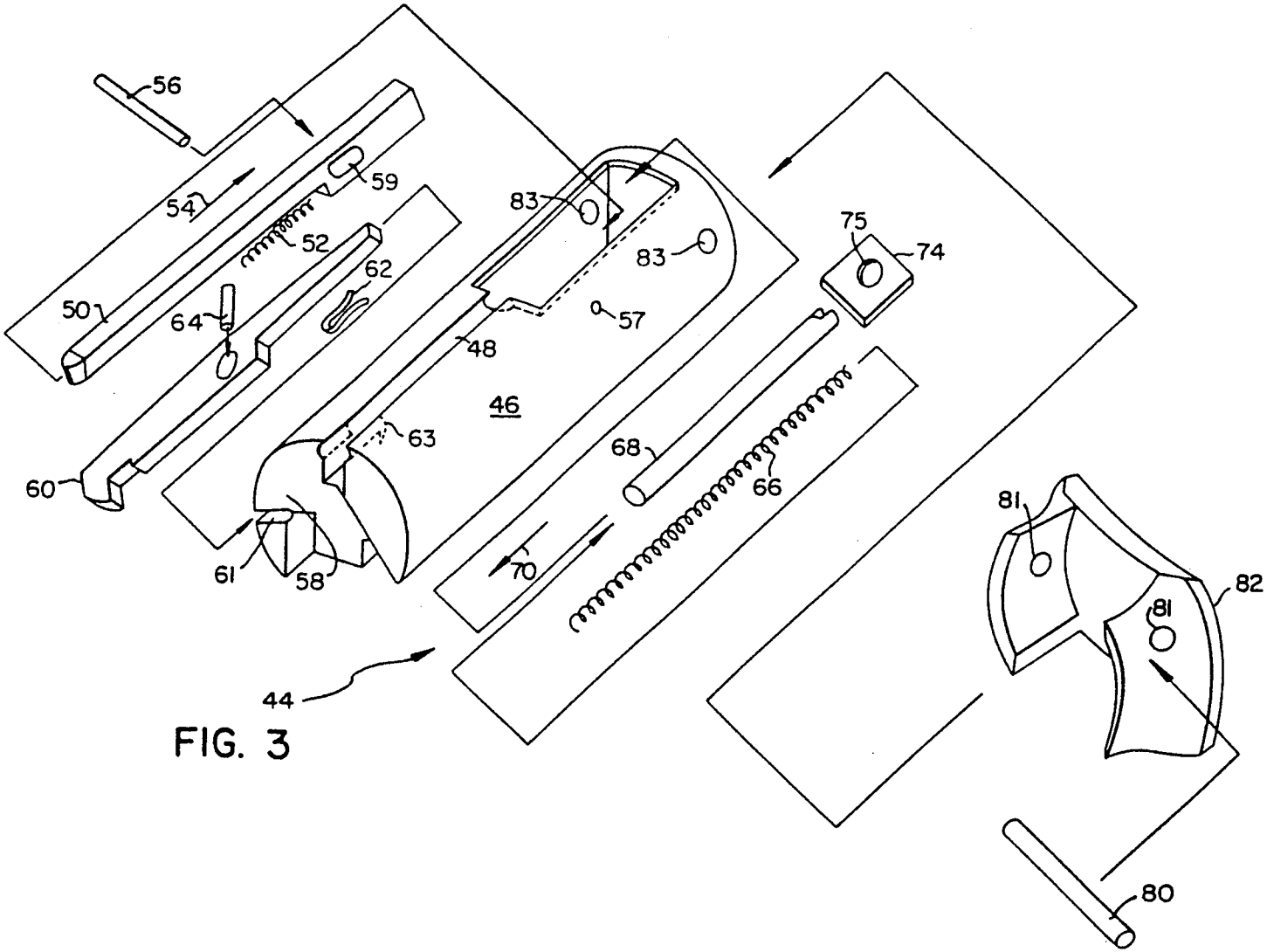
Figure 4:
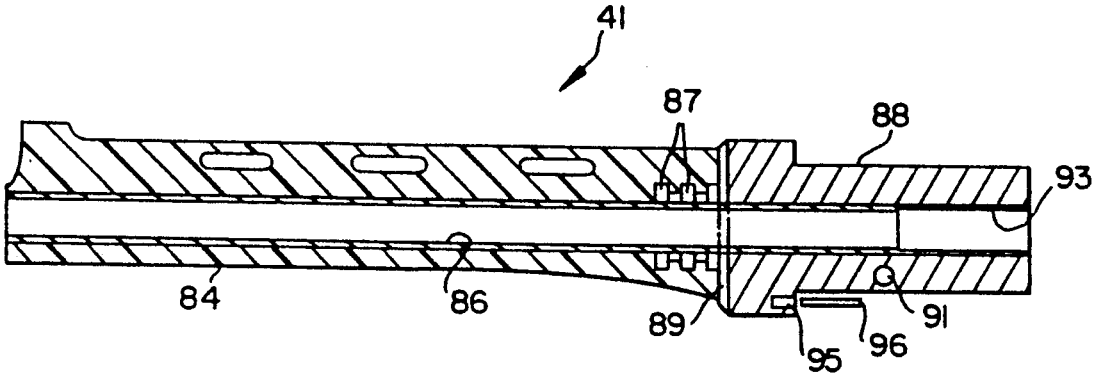
Figure 6:
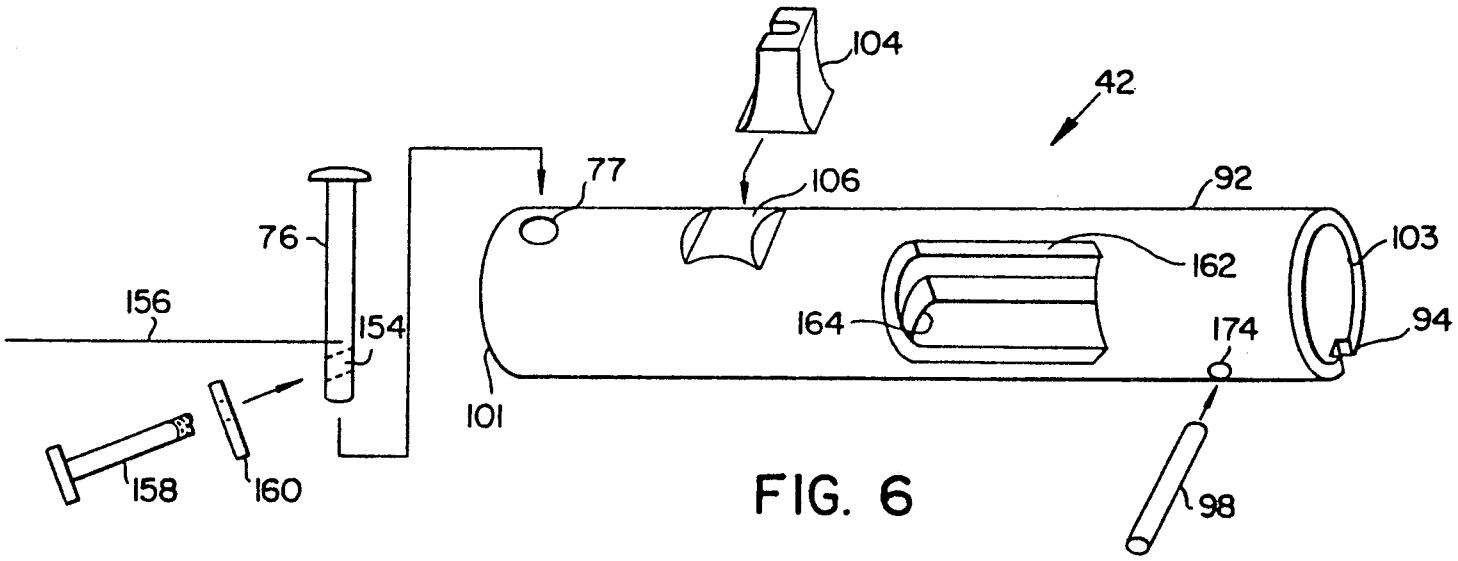
Figure 7:
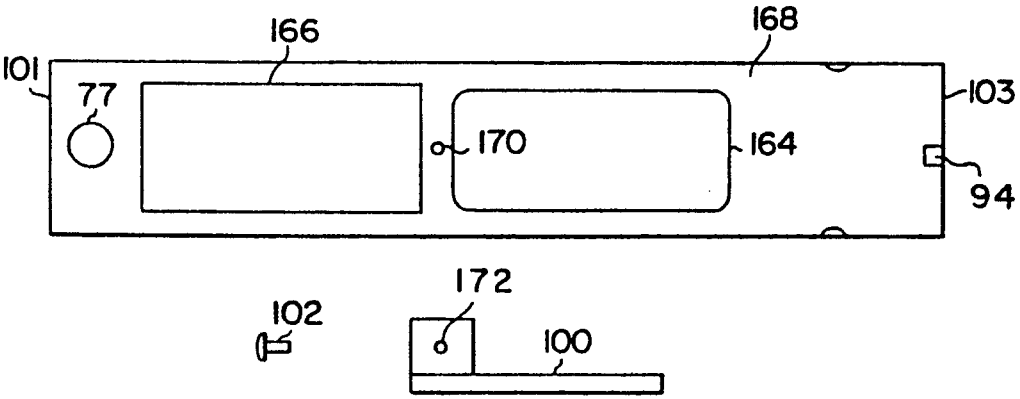
Figure 10:
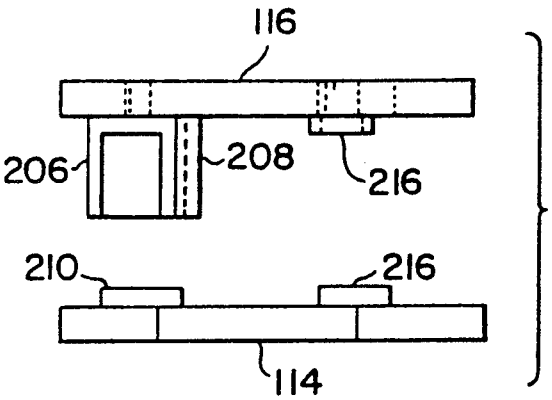
Figure 9:
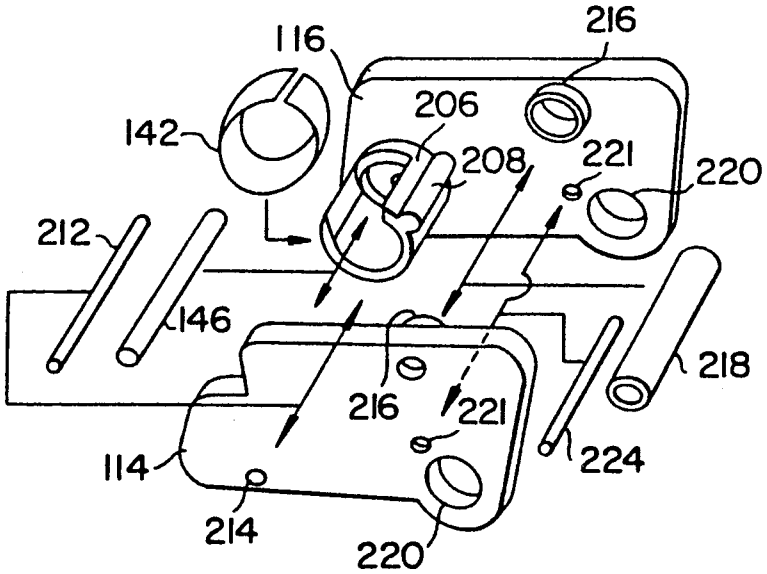
Figure 13:
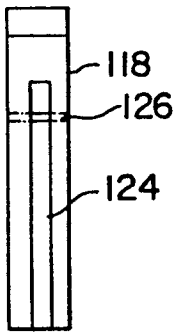
Figure 11:
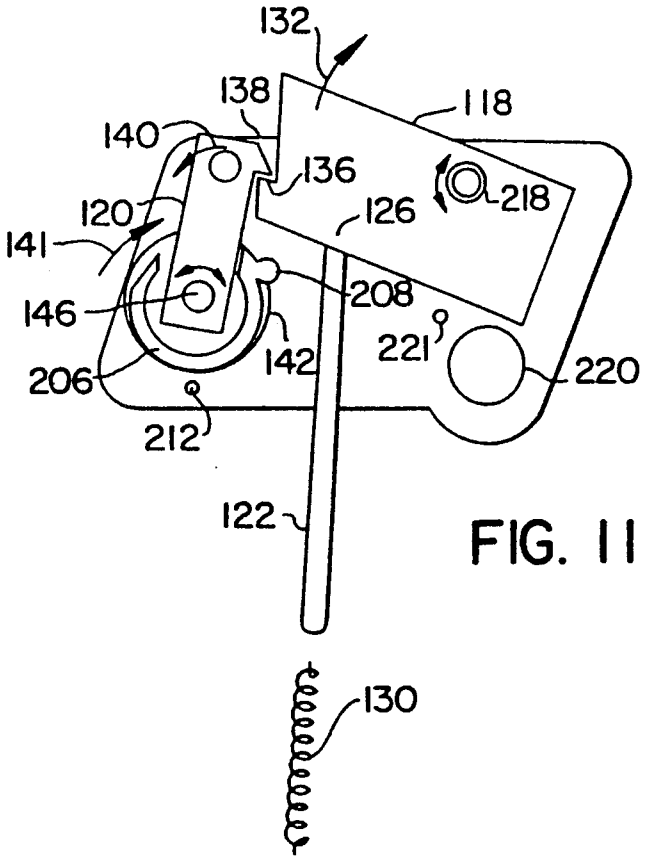
Figure 12:
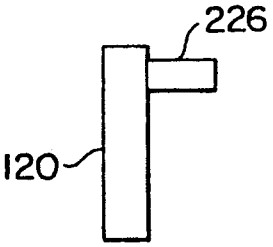
Figure 15:
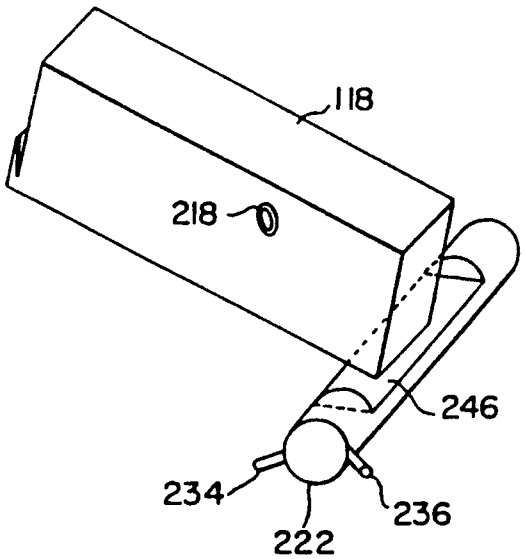
Figure 14:
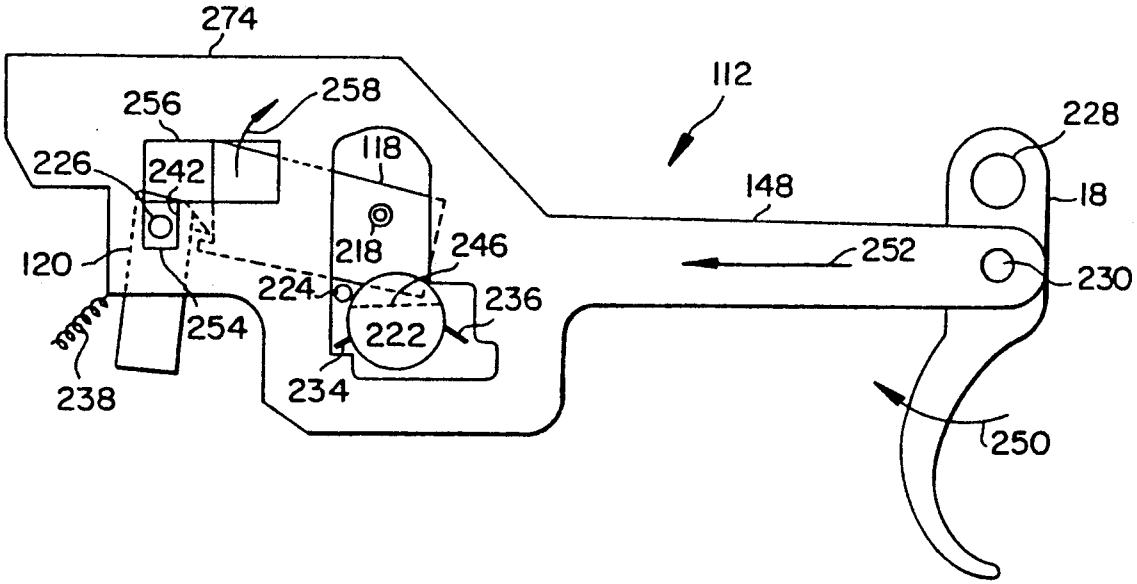
Figure 17:
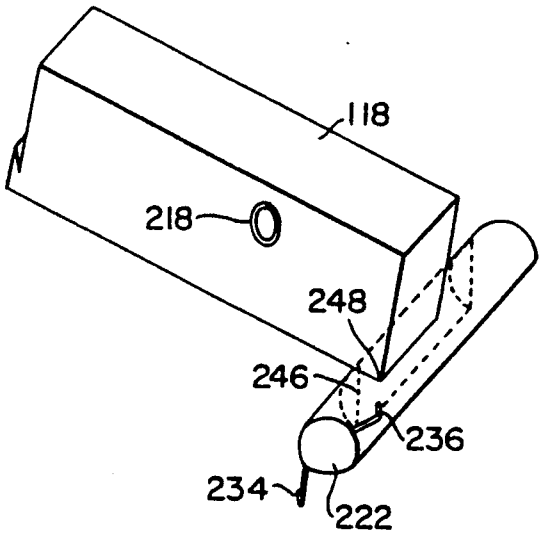
Figure 16:
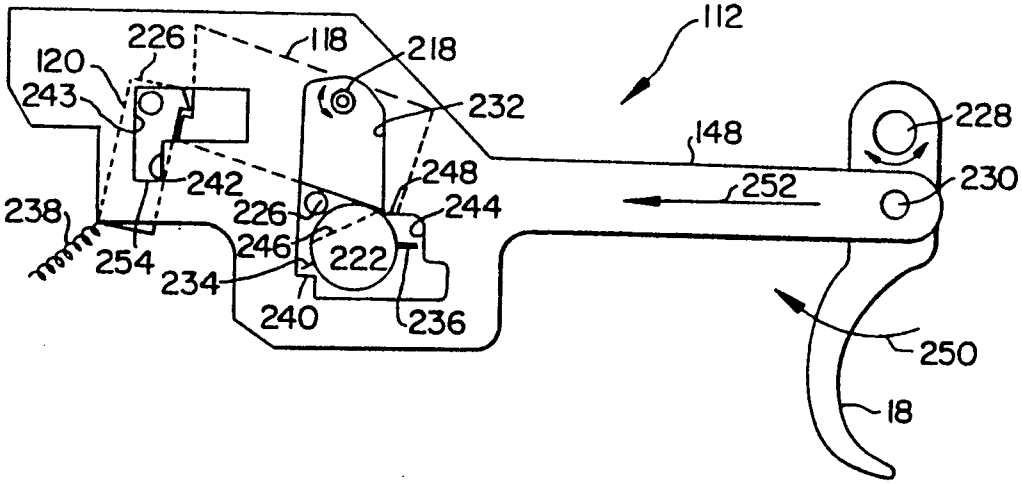
Figure 18:
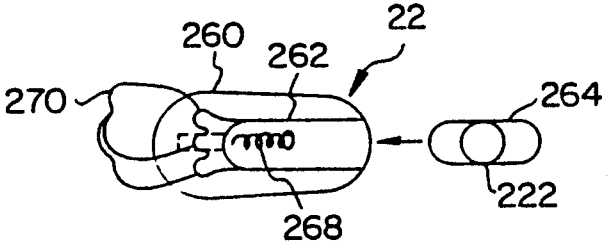

FIGS. *2a* and *2b* are views of a magazine for use with the present invention;

FIG. 3 is an exploded isometric view of a bolt assembly constructed in accordance with the present invention;

FIG. 4 is a cross-sectional view of a barrel assembly constructed in accordance with the present invention;

FIGS. *5a* and *5b* are views of a recoil ring used with the present invention; FIG. 6 is an exploded isometric view of the receiver assembly;

FIG. 7 is a bottom elevation of the receiver assembly;

FIGS. *8a*, and *8b* are views of the grip assembly;

FIG. 9 is an exploded isometric view of the frames for use with the present invention;

FIG. 10 is a top plan view of the frames;

FIG. 11 is a side elevation of the fire control assembly with the right frame removed;

FIG. 12 is a rear elevation of a sear;

FIG. 13 is a rear elevation of a hammer;

FIG. 14 is a side elevation of the fire control assembly with the disconnect and trigger in a firing position;

FIG. 15 is an isometric view of a hammer and safety actuator in a firing position;

FIG. 16 is a side elevation of the fire control assembly with the disconnect and trigger in a safe condition;

FIG. 17 is an isometric view of a hammer and safety actuator in a safe condition;

FIG. 18 is a rear elevation of a safety lever assembly; and

Figure 19:
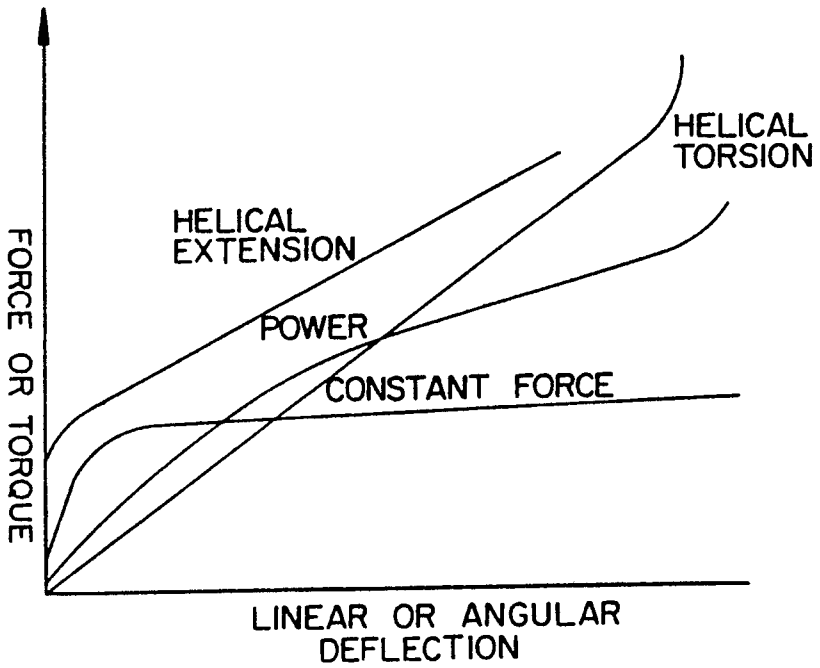

FIG. 19 is a graphical representation of force versus deflection of various springs.

DETAILED DESCRIPTION OF THE INVENTION

Figure 1:
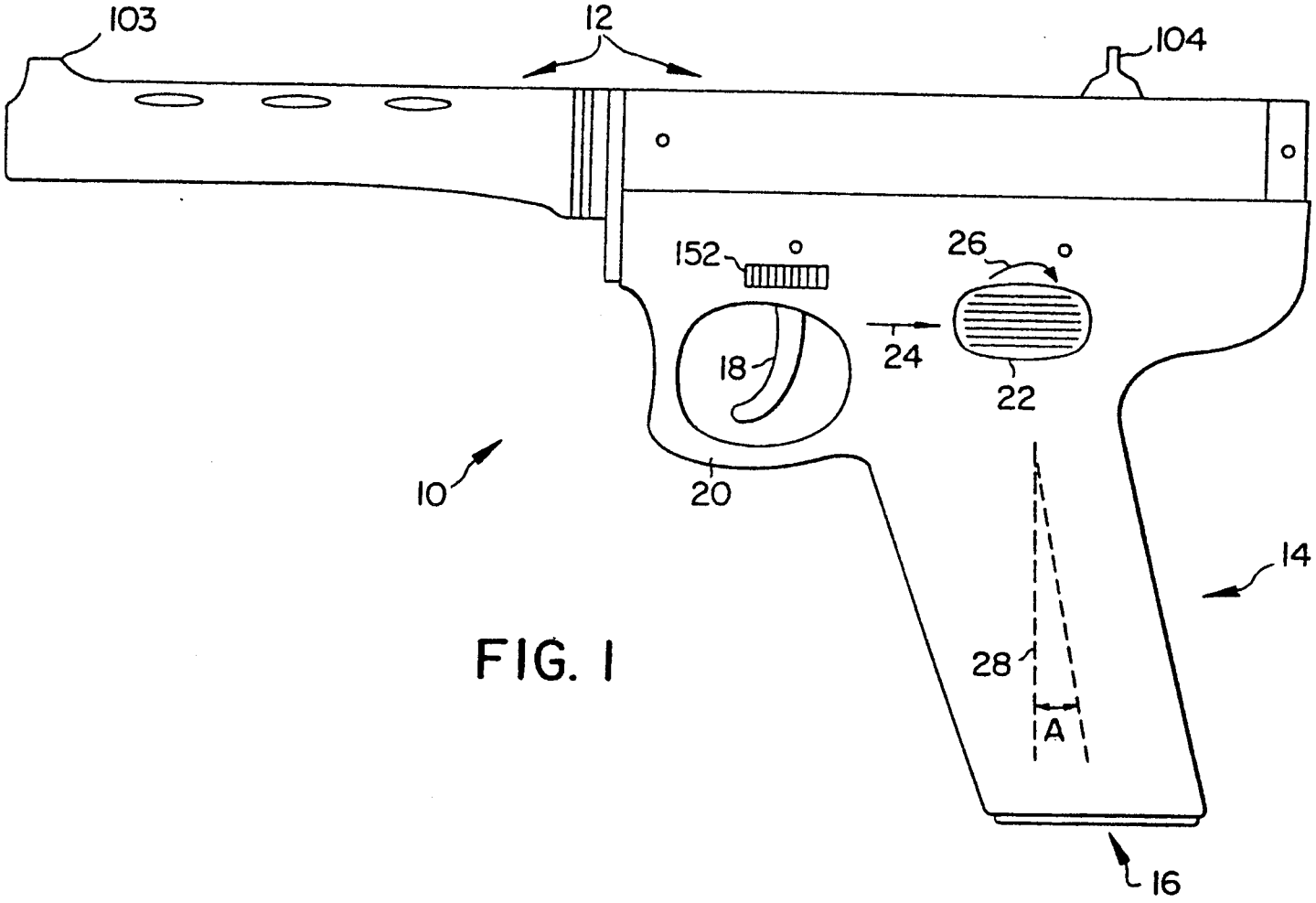
FIG. 1 is a side elevation view of the preferred embodiment of the present invention.

In FIGS. 1 through 18, like items are identified by like and corresponding numerals for ease of reference. Although the following description is in reference to a handgun, it is to be understood that other types of firearms are encompassed by the invention. As used herein, plastic includes plastics, polymers and resinous materials. Additionally, a negator spring or a constant force spring is referred to as a conforce spring. Referring first to FIG. 1, a side elevation view of the preferred embodiment of the present invention is generally identified by the reference numeral 10. The firearm 10 comprises a bolt-barrel-receiver assembly generally identified by the reference numeral 12 and a grip assembly generally identified by the reference numeral 14. Received within the grip assembly 14 is a magazine assembly 16, shown only partially in FIG. 1. The magazine assembly 16 preferably comprises a plastic material and holds a plurality of cartridges, as will be subsequently described in greater detail. A trigger 18 is protected by a trigger guard 20 which is integral with the grip assembly 14.

A safety lever 22 which requires a dual action is pivotally attached to the grip assembly 14. In order to place the firearm 10 in a safe condition, the safety lever assembly 22 is pushed axially as indicated by an arrow 24 and is then pivoted in a clockwise direction as indicated by an arrow 26. To remove the firearm 10 from the safe condition, the safety lever assembly 22 must again be pushed in the axial direction 24 and rotated in a counterclockwise direction opposite the direction 26. The inner parts of the safety assembly 22 will be subsequently described in greater detail.

In an important aspect of the present invention, the grip assembly 14 preferably comprises a single piece of an injection molded polymer. The grip assembly 14 is designed with an angle A of approximately 20° from a vertical line 28 in order to provide a comfortable aiming of the firearm 10. The greater the value of the angle A, the more an operator must bend at the wrist to aim the firearm while gripping the firearm at the end of a straight arm. Thus, the firearm 10 is designed for ease of handling and aiming.

As will be subsequently described in greater detail, other features of the firearm 10 can be seen in FIG. 1. A front sight 103 and a rear sight 104 may be of any generally known type. For example only, the front sight 103 may be an integral molded part of the bolt-barrel-receiver assembly 12 while the rear sight 104 may be an accessory attachment thereto. A magazine release latch assembly 152 is positioned on the grip assembly 14 proximate the trigger 18.

Referring to FIG. *2a*, the magazine assembly 16 comprises a magazine body 30 which preferably comprises a light-weight yet strong plastic material such as, for example, polycarbonate. The magazine body 30 comprises an open top end 31, a closed bottom end 33, a front 35, a rear 37, and left and right sides 39 and 41. As is well known in the art, the open top end 31 includes lips 29 which help retain cartridges therein and guide the cartridges during loading. The magazine body 30 is also provided with externally projecting ribs 32 to provide strength and insure a proper fit within the grip assembly 14. The magazine body 30 is designed to hold a plurality of cartridges (not shown) for sequential loading into the firearm 10. In one embodiment, the magazine body 30 holds 15 cartridges in a single vertical column for individual insertion into a chamber of the firearm 10.

Within the magazine body 30, there is a follower 34 designed to support the cartridges therein during the loading and unloading of cartridges into the magazine assembly 16. At least one conforce spring 36 is provided to bias the follower 34 to a position proximate the open top end 31. The conforce spring 36 may be received within a receptacle 38 within the follower 34 while folded over portion 43 of the spring 36 fits into a slot 45 in the rear 37 of the magazine body 30. The conforce spring(s) 36 provides equal force to the follower 34 throughout the length of the magazine body 30, thus eliminating or greatly reducing pressure variations therein. A notch 40 is formed through the magazine body 30 to allow retention of the magazine assembly 16 within the grip assembly 14 by the magazine release latch assembly 152.

Figure 2B:
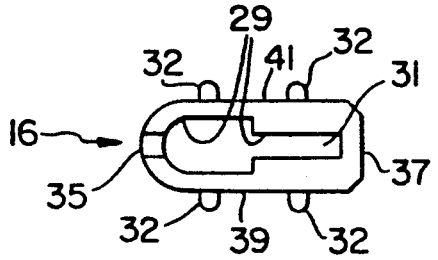
Figure 2A:
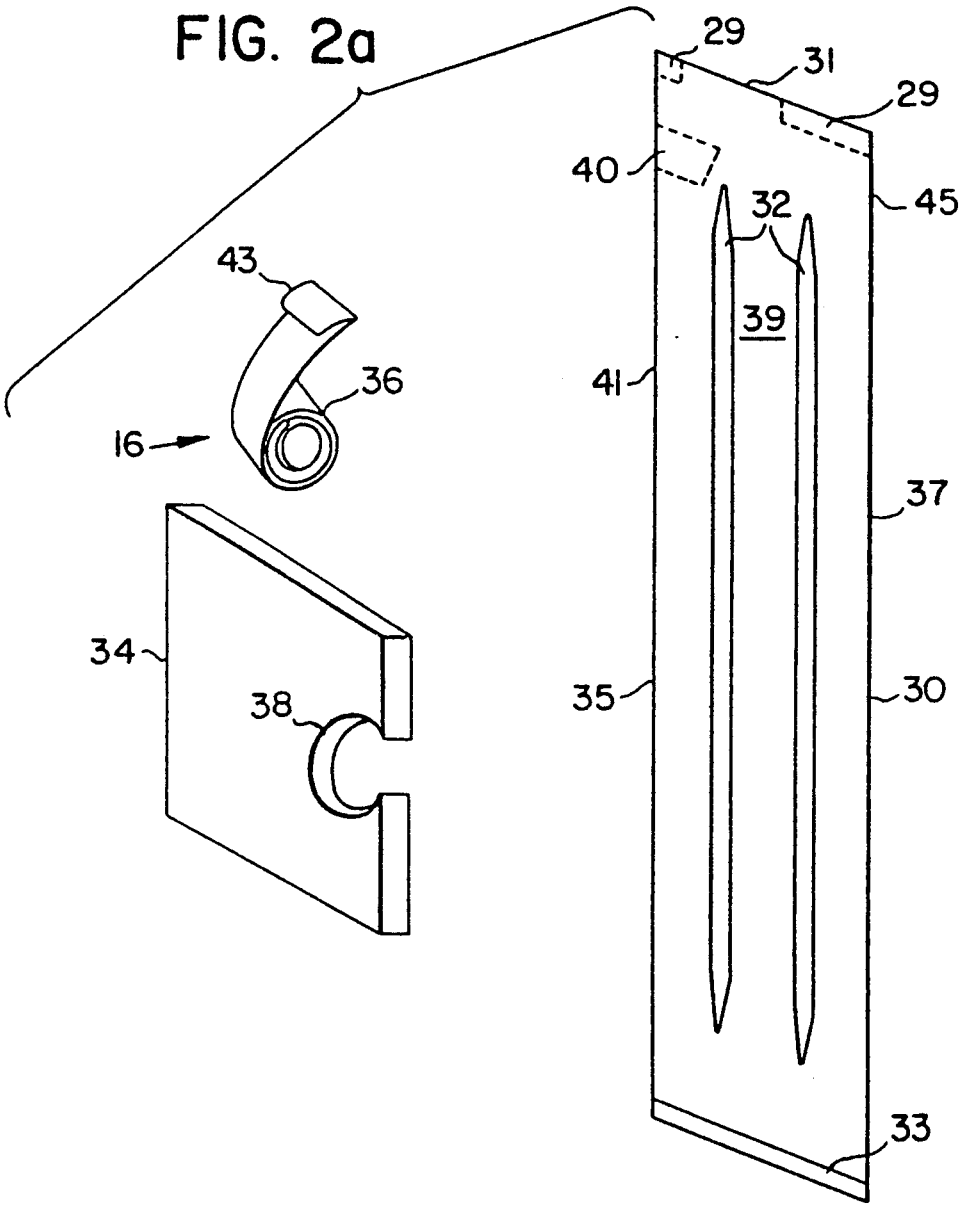

In FIG. 2*b*, a top plan view of the magazine assembly 16 is shown. The ribs 32 are more clearly illustrated as projections extending from the left side 39 and the right side 41 of the magazine body 30. it is to be understood that the exterior appearance of the magazine body 30 can have any number of other configurations so long as the magazine assembly 16 is operably received by the grip assembly 14.

Referring to FIGS. 3–7, the bolt-barrel-receiver assembly 12 comprises a barrel assembly 41, a receiver assembly 42 and a bolt assembly 44. Referring first to FIG. 3, the bolt assembly 44 comprises a bolt 46 formed from a metallic material such as, for example, stainless steel. The bolt 46 is provided with a longitudinally extending slot 48 for receiving a firing pin 50. The firing pin 50 is provided with a firing pin spring 52 to bias the firing pin 50 in a direction as indicated by an arrow 54 which is away from a cartridge when loaded within the firearm 10.

The firing pin 50 is also provided with a firing pin pin 56 which holds the firing pin 50 within the slot 48 of the bolt 46, the firing pin pin 56 passes through a hole 57 in the bolt 46 and a slot 59 in the firing pin 50. The slot 59 allows the firing pin 50 to move about the firing pin pin 56 as necessary to fire a cartridge. As shown, the bolt 46 is designed to fire a rim-fire cartridge such as a 0.22 caliber.

Proximate the bolt face 58 is an extractor 60. The extractor 60 fits within a slot 61 along a side of the bolt 46 and is provided with an extractor spring 62 and an extractor pin 64 which work in conjunction therewith to remove a spent cartridge from the firearm 10. the extractor spring 62 may comprise, for example, a V-spring.

Passing through the bolt 46 along the longitudinal slot 48 and positioned above the firing pin 50 is a recoil spring 66 and a recoil guide rod 68. The recoil spring 66 is held within the slot 48 (prevented from going forward through the bolt face 58) by a spring stop 63. The stop 63 is formed by a smaller diameter in the slot 48 between the stop 63 and the bolt face 58 than in the remaining portion of the slot 48. The recoil spring 66 biases the bolt 46 in a direction indicated by an arrow 70 to return the bolt 46 to the proper firing position after discharge of a cartridge, as is well known in the art. Fixed to the guide rod 68 is a recoil yoke 74 which has a void 75 passing therethrough. The recoil yoke 74, in conjunction with a bolt stop pin 76 (see FIG. 6) which passes through the void 75, helps keep the bolt 46 from flying out of the firearm 10 after firing a cartridge.

Removably attached to the bolt 46 by an actuator pin 80 is an actuator handle 82. The pin 80 passes through a hole 81 in the handle 82 and a hole 83 in the bolt 46. The actuator handle 82 provides a gripping handle to manually charge (load a cartridge and cock the hammer) the firearm 10. The handle 82 also adds mass to the bolt 46 which helps absorb the forces caused by the firing of a cartridge.

In operation, a cartridge at the open end 31 of the magazine assembly 16 would be captured by the bolt face 58 and loaded into a firing chamber 93 (see FIG. 4). When the hammer is released to strike the firing pin 50, the firing pin 50 is driven into and fires the cartridge. Gases released by the firing of the cartridge force the bolt 46 in the direction 54 pulling the spent cartridge from the chamber by the extractor 60. The spent cartridge is then ejected, as will be subsequently described in greater detail. The recoil spring 66 then forces the bolt 46 back along the direction 70 which causes the bolt face 58 to engage the next cartridge in the magazine assembly 16 and load the cartridge.

Referring now to FIG. 4, the barrel-receiver assembly 41 comprises a barrel 84 of a light, yet strong plastic material such as nylon and is provided with a barrel liner 86. The barrel 84 may have any appropriate shape such as, for example, the ribbed design shown in FIG. 4. The barrel liner 86 is a machined metallic material such as steel around which the barrel 84 is molded. The barrel 84 and barrel liner 86 are constructed in accordance with U.S. Pat. No. 4,769,938, to Chesnut et al. Sep. 13, 1988, which is herein incorporated by reference.

In manufacture, the barrel liner 86 is first fixed to a barrel shank 88 by press fitting and/or application of cement. The barrel liner 86 and the shank 88 are then firmly fixed together by the molding of the barrel 84 thereto. The barrel shank 88 is provided with a plurality of protruding ribs 87 to help secure the barrel 84 thereto. A recessed portion 89 is formed in the shank 88 into which the barrel 84 is molded to fill. By filling the recessed portion 89 with the barrel 84, any shrinkage of the barrel 84 caused by the heat of firing will not be exposed.

The barrel shank 88 also has a keyway 95 for receiving an alignment key 96. The alignment key 96 ensures proper alignment and fit between the barrel assembly 41, the receiver assembly 42 and the grip assembly 14, as will be subsequently described in greater detail. A recoil pin 98 (see FIG. 6) passes through a hole 91 in the shank 88 to secure the barrel assembly 41 to the receiver assembly 42.

A chamber 93 is formed in the barrel liner 86 for the receipt of a cartridge. Although not shown, it is to be understood that an appropriate cut out is formed between the chamber 93 and the shank 88 for the proper fit and action of the ejector 60 (see FIG. 3).

Figure 5A:
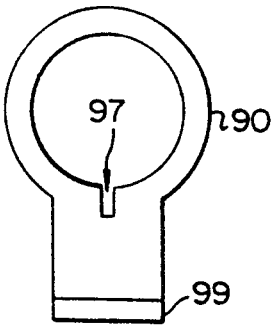
Figure 5B:
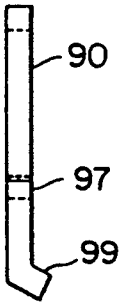

Referring simultaneously to FIGS. 5*a* and 5*b*, a recoil ring 90 is illustrated. The recoil ring 90 is provided with a slot 97 for proper alignment with the barrel assembly 41 by the key 96. The ring 90 is inserted over the barrel shank 88 past the chamber 93 into engagement with the key 96. An angled portion 99 is provided on the ring 90 for alignment with a cut out 294 (see FIG. 8*a*) on the grip assembly 14. The angled portion 99 is thus positioned to face toward and engage with the grip assembly 14. The angled portion 99 holds the barrel assembly 41 simultaneously back and down (like a dovetail) onto the grip assembly 14.

Referring to FIGS. 6 and 7, the receiver assembly 42 comprises a receiver 92. The receiver 92 may comprise a metallic material, such as, for example, hard anodized aluminum which is strong, scratch resistant and lightweight. The receiver 92 slidably receives the bolt assembly 44 therein through the first end 101 such that the actuator handle 82 extends therefrom. A second end 103 of the receiver 92 receives the barrel assembly 41. A cut out 94 at the second end 103 receives the key 96 to properly align the receiver assembly 42 with the barrel assembly 41.

A bolt stop pin 76 passes through a hole 77 in the receiver 92 proximate the first end 101. The pin 76 also passes through the void 75 in the recoil yoke 74 (see FIG. 3) as previously described above. The stop pin 76 is provided with a threaded passageway 154 formed at an angle, for example, 15°, back and down with reference to a horizontal line 156. The passageway 154 receives a takedown screw 158 which also passes through the grip assembly 14 to secure the bolt-barrel-receiver assembly 12 to the grip assembly 14. A washer 160 is also provided to fit between the takedown screw 158 and the grip assembly 14. Thus, the first step in disassembly of the firearm 10 is to remove the takedown screw 158 to separate the bolt-barrel-receiver assembly 12 from the grip assembly 14.

The receiver 92 has an ejection port 162 formed therein proximate the second end 103. The ejection port 162 allows a spent casing (or a complete cartridge) to be ejected from the firearm 10. Referring to FIG. 7, a magazine port 164 and a fire control port 166 can be seen on the bottom 168 of the receiver 92. The magazine port 164 allows the magazine assembly 16 to align a cartridge with the receiver 92 for loading into the chamber 93 (see FIG. 4). The fire control port 166 allows passage of a hammer 118 (see FIG. 11) therethrough for engagement with the firing pin 50 (FIG. 3). An ejector 100 is secured to the receiver 92 by an ejector rivet 102 through a hole 170 in the receiver 92 and a hole 172 in the ejector 100. The ejector 100 stops a spent casing or a cartridge being extracted from the chamber 93 by the extractor 60 (see FIG. 3) for ejection through the ejection port 162, as is well known in the art.

The firearm 10 may be provided with a rear sight 104 which may be press fit into a dovetail slot 106 on the receiver 92. As previously described above, a recoil pin 98 passes through a hole 174 in the receiver 92 and the hole 91 in the shank 88 for connection of the barrel assembly 41 to the receiver assembly 42.

Figure 8A:
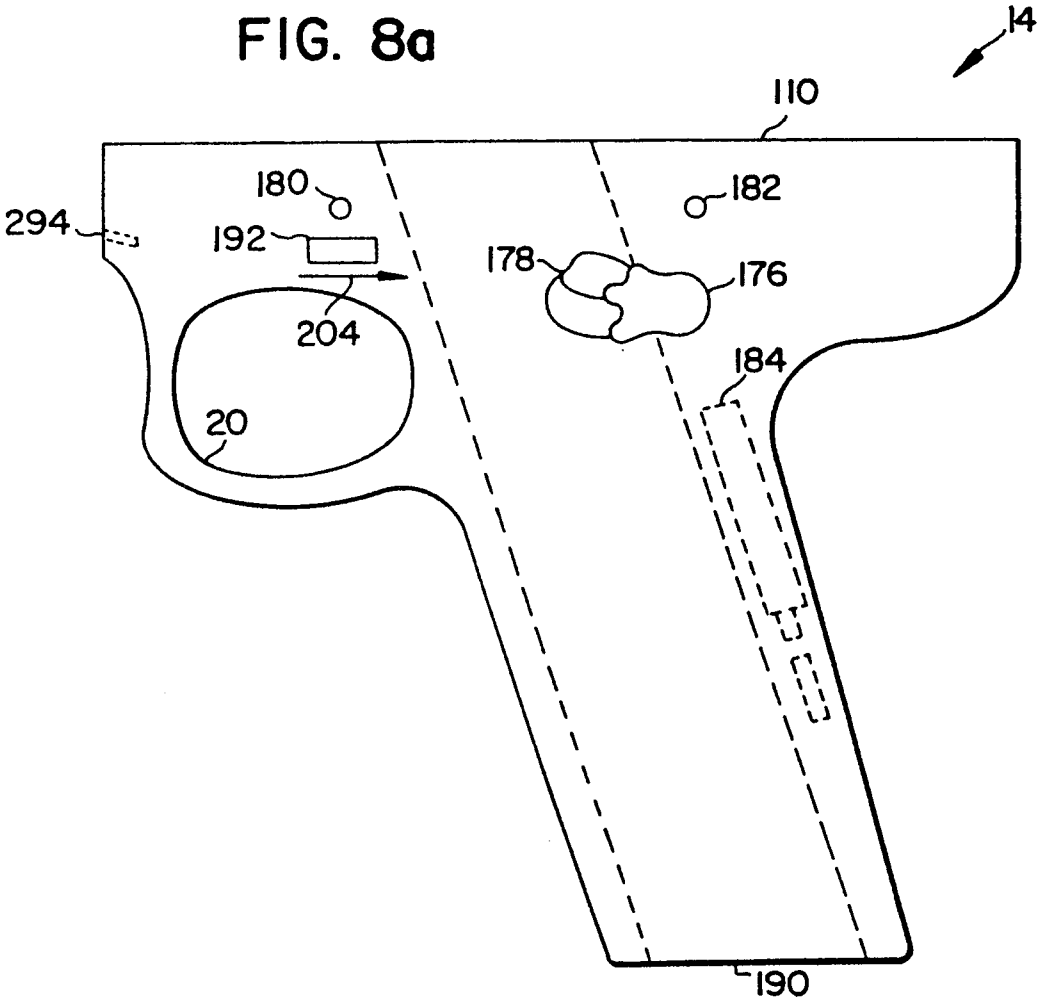
Figure 8B:
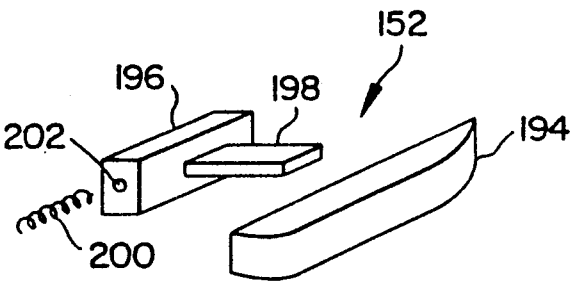

Referring to FIGS. 8*a*, and 8*b*, the grip assembly 14 comprises a grip body 110 which contains a fire control assembly 112 (see FIG. 9). The grip body 110, as previously described above, preferably comprises a one piece, molded plastic material such as nylon. In an important aspect of the present invention, the grip body 110 is formed without any integrally molded metallic parts as opposed to the Glock handgun (U.S. Pat. No. 4,539,889, to Glock, Sep. 10, 1985) which is formed with a plurality of integral metal parts. Therefore, the grip body 110 is preferably formed with a detectable material mixed into the plastic material. This detectable material will prevent undetected passage of the grip body 110 through airport security devices.

The grip body 110 is formed with a safety lever receptacle 176. The receptacle 176 has a plurality of finger receptacles 178 for matching with the safety lever assembly 22, as will be subsequently described in greater detail. Two holes 180 and 182 pass through the grip body 110 for securing the fire control assembly 112 therein. A strut receptacle 184 is formed in the body 110 to receive and guide a hammer strut 122 (see FIG. 11).

Referring to FIG. 8*a*, the grip body 110 has a magazine well 190 passing therethrough. The magazine well 190 is formed to match with and receive the magazine assembly 16. Also formed through the grip body 110 proximate the trigger guide 20 is a magazine release latch receptacle 192.

Referring to FIG. 8*b*, the magazine release latch assembly 152 is shown. The assembly 152 comprises a latch release handle 194 for external attachment to the grip body 110. A magazine release block 196 is positioned within the grip body 110 with a projection 198 passing through the receptacle 192 for engagement with the handle 194. The projection 198 may be secured to the handle 194 by any appropriate method such as gluing or pinning (not shown). A biasing spring 200 which may fit within a hole 202, biases the assembly 152 into engagement with the notch 40 in the magazine assembly 16 (see FIG. 2*a*), as indicated by an arrow 204 (FIG. 8*a*). To release the magazine assembly 16, the assembly 152 must be pushed in a direction opposite the direction 204.

Referring to FIGS. 9 and 10, the fire control assembly 112 comprises a right frame 114 and a left frame 116. The frames 114, 116 are preferably constructed of a light weight plastic material such as nylon. As will be subsequently described, attached between the frames 114, 116 is a hammer 118 and a sear 120 (see FIG. 11).

Formed integrally with the left frame 116 is a sear spring support 206. The spring support 206 is a hollow, partial cylinder around which the sear spring 142 is positioned and within which the sear 120 (see FIG. 11) is positioned. The support 206 has a catch surface 208 which serves to help secure the spring 142 thereto. As will be subsequently described in greater detail, the sear spring 142 comprises a conforce spring. The spring support 206 mates with a projection 210 (see FIG. 10) formed integrally with the right frame 114.

A sear pin 146 about which the sear 120 pivots, is secured within the support 206 between the left frame 116 and the right frame 114. Below the support 206, a retaining pin 212 is connected between the left frame 116 and the right frame 114 by hole 214 (shown in right frame 114 only). The retaining pin 212 helps keep the sear spring 142 in position about the support 206, and, most importantly, it forms a point about which a constant force moment arm is developed. Fixed between integral receptacles 216 on the frames 114, 116 is a hammer pivot tube 218. While the pivot tube 218 is fixed against movement, the hammer 118 (see FIG. 11) is free to pivot around the tube 218, as will be subsequently described in greater detail. A hole 220 is formed through each frame 114, 116 for passage of a safety actuator 222 (see FIG. 15). Holes 221 are formed through the frames 114, 116 for insertion of a frame retaining pin 224 which holds the frames 114, 116 in the grip assembly 14.

Referring to FIG. 11, the hammer 118 comprises a metallic material with a hammer strut 122 attached within a slot 124 (see FIG. 13) by a strut pin 126. The hammer strut 122 is received within the strut, receptacle 184 (see FIG. 8a) within the grip body 110. A hammer spring 130 is positioned over the hammer strut 122 to provide a force to pivot the hammer 118 about the hammer pivot tube 218 into engagement with the firing pin 50 (see FIG. 3).

The hammer 118 is formed with a sear contact surface 136 which is matched to a hammer contact surface 138 on the sear 120. The contact surfaces 136–138 are formed at approximately 15° from horizontal to ensure positive engagement therebetween. Thus, as can be appreciated, when the sear 120 is forced away from the hammer 118 to fire the firearm 10, some degree of further cocking of the hammer 118 occurs prior to release thereof. When the firearm 10 is cocked into the firing position, the hammer 118 is held in the ready or cocked position (as shown in FIG. 11) by the hammer contact surface 138 matching with the sear contact surface 136. To fire the firearm 10, the sear 120 is rotated in a direction indicated by arrow 140 to release the hammer 118. The sear 120 is biased in a direction opposite that of the arrow 140, as shown by an arrow 141, by the sear spring 142.

Thus, the forces on the hammer 118 are in a direction indicated by arrow 132 by the strut spring 130 when the hammer 118 is cocked, and the forces on the sear 120 are in the direction 141 by the sear spring 142. While the sear 120 is biased toward contact with the hammer 118, the hammer 118 is biased away from contact with the sear 120. Therefore, when the sear 120 is moved in the direction 140, as will be subsequently described in greater detail, the hammer 118 is released and forced in the direction 132 by the strut spring 130.

It is an important aspect of the present invention that the contact surfaces 136, 138 are formed distal the pivot points for the hammer 118 and the sear 120. The sear contact surface 136 on the hammer 118 is formed distal the pivot tube 218, about which the hammer 118 pivots. The hammer contact surface 138 on the sear 120 is formed distal the sear pin 146, about which the sear 120 pivots. Since the surfaces 136, 138 are generally at the circumference of each pivot radius, less force is required to both hold the hammer 118 in a cocked position and move the sear 120 out of engagement therewith to fire the firearm 10. Therefore, the sear spring 142 does not require excessive force to hold the sear 120 in engagement with the hammer 118. Thus, the force needed to overcome the sear spring 142 to fire the firearm 10 is likewise not excessive.

In an important aspect of the present invention, the sear spring 142 comprises a conforce spring. The sear spring 142 is wrapped around the support 206 and held in place by the retaining pin 212 and the catch surface 208. As can be seen with reference to FIG. 19, the use of a conforce spring rather than conventional springs provides the firearm 10 with a distinct advantage over other known firearms, i.e., a more uniform trigger pull throughout. Other springs require increased force throughout their operating ranges, thus as an operator pulls the trigger, the force required becomes gradually greater up to the point of firing. Contrarily, a conforce spring requires a more constant pull throughout and thus will greatly increase evenness of trigger "pull."

Referring to FIG. 12, a rear plan view of the sear 120 is shown. The sear 120 has a disconnect pin 226 protruding therefrom for contact with a disconnect 148 (see FIG. 14). The sear 120 is forced to pivot about the sear pin 146 by a force applied to the disconnect pin 226.

Referring to FIG. 14, the fire control assembly 112 is connected to a disconnect 148 and the trigger 18. The disconnect 148, the trigger 18 and the frames 114, 116 fit within the grip assembly 14 and are held therein by the frame retaining pin 224 (FIG. 9) and a retaining pin 228 which pass through the holes 182 and 180 (see FIG. 8a), respectively. Thus, the fire control assembly 112 may be removed as an assembly for cleaning or servicing by simply removing the frame retaining pin 224. The disconnect 148 and the trigger 18 may likewise be removed by removing the retaining pin 228. The trigger 18 pivots about the retaining pin 228 and is connected to the disconnect 148 by a pin 230.

The disconnect 148 has a firing window 254 with a firing contact surface 242 and a no-fire window 256 adjacent thereto. When the safety actuator 222 is in the "unsafe" or "fire" position, as shown in FIG. 14, the disconnect pin 226 is positioned within the firing window 254. Thus, when an operator pulls the trigger 18 which pivots about pin 228 in a direction 250, the disconnect 148 is moved in a direction 252. The movement of the disconnect 148 pushes the sear 120 away from the hammer 118 by contact between the disconnect pin 226 and the firing window 254. The hammer 118 is released to pivot about the pivot tube 218 in a direction 258 to contact the firing pin 50 (FIG. 3) to fire the firearm 10. The hammer 118 is able to pivot in the direction 258 past the safety actuator 222 because a hammer passage surface 246 (see FIG. 15) is generally horizontal.

The disconnect 148 has a bolt interface surface 274 which is contacted by the bolt 46 (see FIG. 3) as the bolt 46 is forced away from the chamber 93 after the firing of a cartridge. As the bolt 46 passes over the surface 274, the disconnect 148 is forced downwardly against the bias of a disconnect spring 238. The downward movement pushes the firing window 254 away from the disconnect pin 226 which inhibits accidental premature discharge. As the bolt 46 returns to load a cartridge, the disconnect 148 is allowed to move upward by the bias of the spring 238 which returns the firing window 254 into contact with the disconnect pin 226.

Referring to FIG. 16, a void 232 within the disconnect 148 allows passage of the frame retaining pin 226 and the safety actuator 222 and provides surfaces for engagement of safety pins 234 and 236.

As shown in FIG. 16, the safety actuator 222 is in the "safe" position The pin 234 has pushed the disconnect 148 down against the biasing action of a disconnect spring 238 by engaging a surface 240 adjacent the void 232. In this position the disconnect pin 226 is removed from the firing contact surface 242 of the firing window 254. Thus, movement of the sear 120 away from engagement with the hammer 118 is blocked by the surface 243 contacting the disconnect pin 226. Additionally, the safety pin 236 is engaging the safety surface 244 adjacent the void 232 which prevents movement of the disconnect 148 and the trigger 18. Further, the safety actuator 222 blocks rotation of the hammer 118 by rotation of the hammer passage 246 (see FIG. 17) away from a horizontal plane. Thus, the portion 248 of the hammer 118 is blocked by the safety actuator 222 and the hammer 118 cannot rotate out of engagement with the sear 120.

The firearm 10 is therefore provided with multiple safety features. The safety actuator 222, in combination with the disconnect 148, blocks the hammer 118, blocks the sear 120, disengages the sear 120 and blocks the disconnect 148. When in the "safe" position, the hammer 118 could not pivot due to the actuator 222 and the position of the passage 246 even if the trigger were pulled and even if the sear 120 were to disengaged therefrom. The sear 120 cannot pivot because the surface 243 of the no-fire window 256 blocks movement thereof. However, if the disconnect 148 were to move in the direction 252, the sear 120 would not pivot because the no-fire window 256 has no surface (such as the surface 242 in the fire window 254) to engage the disconnect pin 226. Additionally, the disconnect 148 cannot be moved in the direction 252 by pulling the trigger 18 because movement of the disconnect 148 is blocked by the safety pin 236.

Referring to FIG. 18, the safety lever assembly 22 is shown. The assembly 22 comprises a safety lever 260 with a recessed area 262. The recessed area 262 slidably receives a portion 264 which connects through the grip assembly 14 to the safety actuator 222. The actuator 222 may be connected to the portion 264 by any appropriate method such as gluing or pinning (not shown).

The safety lever 260 also comprises a spring 268 which biases the lever 260 away from the portion 264. Protruding fingers 270 extend from the surface of the lever 260 and match the finger receptacles 178 in the safety lever receptacle 176 on the grip body 110 (see FIG. 8*a*). The protruding fingers 270 mate with the finger receptacles 178 when the safety lever 260 is in the "safe" position. Thus, due to the bias created by the spring 268, it is necessary to perform the two direction (axial and radial) movement, as previously described above, to disengage the firearm 10 from the "safe" condition.

Thus, the firearm 10 is light weight, safe and relatively simple to operate. The incorporation of plastics into the structure of the firearm 10 wherever practicable makes for a lighter firearm. The lighter the firearm, the less likely is an operator to become quickly fatigued by use thereof. The firearm 10 also incorporates a plurality of interconnected safety features. The hammer 118 can be prevented from movement, the sear 120 can be prevented from movement and the disconnect 148 can be prevented from movement. To take the firearm 10 out of a "safe" condition, a dual motion is required. Thus, the safety lever assembly 22 is less likely to be accidentally moved into the "fire" position. Due to the use of sub-assemblies, the firearm 10 is relatively simple to take apart for cleaning and repair. The conforce spring used as the sear spring 142 allows a steady, even pull to fire the firearm 10.

Although the present invention has been described with respect to a specific preferred embodiment thereof, various changes and modifications may be suggested to one skilled in the art, and it is intended that the present invention encompass such changes and modifications as fall within the scope of the appended claims.

We claim:

1. A gun, comprising:

a barrel assembly with a chamber for accommodating a cartridge and a barrel for accommodating a bullet upon discharge of said cartridge;

means for use in positioning said cartridge in said chamber, said means for use in positioning includes a magazine assembly for holding a plurality of cartridges;

means for use in discharging a cartridge that has been positioned in said chamber, said means for discharging includes a trigger, a firing assembly that has a hammer and that is operatively connected to said trigger, and a firing pin for striking a cartridge that has been positioned in said chamber, said firing pin located so as to be struck by said hammer, wherein actuation of said trigger causes said hammer to strike said firing pin which then strikes a cartridge positioned in said chamber to discharge said cartridge so that a bullet traverses said barrel;

a first exterior portion;

a second exterior portion that includes a grip portion for providing support to whichever hand of a shooter is used to actuate said trigger, said grip portion accommodates at least a portion of said magazine assembly;

wherein said first exterior portion and said second exterior portion cooperatively form a housing for containing substantial portions of said barrel assembly, said means for use in positioning, and said means for use in discharging;

first means for operatively connecting each of said barrel assembly, said means for use in positioning, and said means for use in discharging to said housing; and second means for operatively connecting said first exterior portion to said second exterior portion, said second means includes a pin having a threaded passageway that is at an acute angle to a longitudinal axis of said pin, said pin extending into said housing, said second means further including a screw extending into said housing and engaging said threaded passageway.

* * * * *